US005877270A

United States Patent [19]

Takayama et al.

[11] Patent Number: 5,877,270

[45] Date of Patent: Mar. 2, 1999

[54] WATER SOLVENT EXTRACTION DEGREASING METHOD AND MOLDED PRODUCTS PRODUCED THEREWITH

[75] Inventors: Takemori Takayama; Yoshitaka Ohyama, both of Osaka; Masato Miyake, Ishikawa; Katsuyoshi Saito, Kyoto; Hiroshi Ono, Saitama, all of Japan

[73] Assignee: Kabushiki Kaisha Komatsu Seisakusho, Tokyo, Japan

[21] Appl. No.: 775,896

[22] Filed: Jan. 2, 1997

Related U.S. Application Data

[63] Continuation-in-part of Ser. No. 403,199, Mar. 13, 1995, Pat. No. 5,627,258.

[30] Foreign Application Priority Data

Mar. 14, 1994 [JP] Japan ..... 6-042643
Oct. 3, 1996 [JP] Japan ..... 8-263222

[51] Int. Cl.[6] ..... C08G 69/26; C04B 35/64

[52] U.S. Cl. ..... 528/338; 528/310; 528/322; 528/329.1; 528/332; 528/339; 528/340; 528/341; 524/100; 524/227; 524/600; 524/607; 419/36; 419/37; 264/63; 264/344

[58] Field of Search ..... 528/310, 338, 528/322, 329.1, 339, 340, 341, 332; 524/100, 227, 600, 606; 419/37, 36; 264/344, 63

[56] References Cited

U.S. PATENT DOCUMENTS

| | | | |
|---|---|---|---|
| 4,197,118 | 4/1980 | Weich, Jr. | 75/228 |
| 4,500,665 | 2/1985 | Brecker et al. | 524/227 |
| 4,964,907 | 10/1990 | Kiyota et al. | 75/235 |
| 5,002,988 | 3/1991 | Ono et al. | 524/100 |
| 5,059,388 | 10/1991 | Kihara et al. | 419/37 |
| 5,380,476 | 1/1995 | Matsushita et al. | 264/63 |
| 5,531,958 | 7/1996 | Krueger | 419/44 |
| 5,627,258 | 5/1997 | Takayama et al. | 528/338 |

FOREIGN PATENT DOCUMENTS

| | | |
|---|---|---|
| 61-48563 | 10/1986 | Japan . |
| 62-33282 | 7/1987 | Japan . |
| 2-101101 | 4/1990 | Japan . |
| 2-182803 | 7/1990 | Japan . |
| 2-182804 | 7/1990 | Japan . |
| 2-305903 | 12/1990 | Japan . |
| 5-331503 | 12/1993 | Japan . |
| 6-192706 | 7/1994 | Japan . |
| 6-200303 | 7/1994 | Japan . |
| 7-305101 | 11/1995 | Japan . |
| 1 516 079 | 6/1978 | United Kingdom . |

OTHER PUBLICATIONS

Powder Molding Handbook, published on Feb. 27, 1987 by the Nikkan Kogyo Shinbun Ltd. (see p. 6 of spec.).
Injection Molding Techniques For Fine Ceramics (issued on Mar. 30, 1987 by the Nikkan Kogyo Shinbun Ltd.
Powder and Powder Metallurgy, vol. 40, No. 4 (issued on Sep. 21, 1966) by the Japan Society of Powder and Powder Metallurgy) (see p. 14 of spec.).

*Primary Examiner*—P. Hampton-Hightower
*Attorney, Agent, or Firm*—Armstrong, Westerman, Hattori, McLeland & Naughton

[57] ABSTRACT

A water solvent extraction degreasing method capable of reducing degreasing time without consideration of abrupt decomposition/vaporization and swelling caused by heat. An organic binder is removed from a molded product that is produced by a powder material mixed with the organic binder and this organic binder contains at least one water-soluble organic compound and at least one water-insoluble thermoplastic resin. The degreasing step of this method includes a water solvent extraction step for extracting the water-soluble organic compound from the organic binder contained in the molded product, using water as a solvent.

31 Claims, 12 Drawing Sheets

WATER SOLVENT EXTRACTION DEGREASING METHOD AND MOLDED PRODUCTS PRODUCED THEREWITH

This application is a continuation-in-part of application Ser. No.08/403,199, filed Mar. 13, 1995, U.S. Pat. No. 5,627,258.

TECHNICAL FIELD

The present invention relates to a water solvent extraction degreasing method for degreasing an organic binder contained in an injection-molded product that is formed from a powder material mixed with the organic binder and to molded products produced therewith.

BACKGROUND ART

Generally, metal powder injection molding for producing sintered products is composed of the sequential steps of (i) injection molding in which a binder is added to a metal powder material to provide pressure-moldability thereto and then the mixture is formed into a molded form; (ii) degreasing for removing the binder from the molded form; and (iii) sintering of the degreased, molded form. Such metal powder injection molding has advantages over other methods such as the metal powder press molding process in that products of intricate shapes can be produced through a single process and that less post-treatments are required. These characteristics are not only suited for the production of small-sized metal parts and but also economically advantageous.

Powder injection molding however presents a disadvantage. That is, since this technique uses large amounts of binder for providing hydrostatic pressure moldability, collapsing, blistering and cracking are more likely to occur in the resultant, molded products particularly in the steps of degreasing and sintering compared to other ordinary powder metallurgical processes. In order to prevent such collapsing, blistering and cracking, removal of the binder has to be proceeded slowly in the degreasing step, so that it usually takes two or three days to perform the degreasing step, although the time required for it principally depends on the shape and thickness of molded products to be produced. Collapsing, blistering, cracking and the prolonged degreasing step are the outstanding problems for powder injection molding.

There have been proposed several techniques to eliminate various defects as mentioned above during removal of a binder from injection-molded products. One example of such techniques is disclosed in Japanese Patent Publication No. 61-48563 (1986) in which degreasing is carried out with a turbulent flow of inert gas blown to injection-molded products and part of binder components dissolved in a porous form is absorbed. Japanese Patent Publication No. 62-33282 (1987) discloses a degreasing method for maintaining the pressure in the atmosphere for injection-molded products to be no less than the vapor pressure of the thermoplastic binder.

However, it is practically difficult to keep the interior of a degreasing furnace in a uniform turbulent condition. Even if temperature can be kept uniform, the binder removing speed on the side of an injection-molded product exposed to blown air differs from that on the side opposite to the exposed side, with the result that the degree of degreasing undesirably varies within a single piece of injection molded product. When a setter is used for effective arrangement of injection molded products in a degreasing furnace, non-uniform degreasing is often seen in areas contacting the setter or areas from which a turbulent flow of air is shut out. Such non-uniformity is remarkable particularly when a plurality of injection molded products are processed in a binder removal furnace, resulting in variations in the degree of degreasing between the injection molded products. For the above reason, it is practically infeasible to produce sound degreased products free from defects such as deformation due to the inherent weight of the products themselves, blister and cracks.

It is also contemplated in the above publication that a thermoplastic binder composed of binder components of different melting points is used and these components are allowed to sequentially, gradually flow out from the injection molded products in the form of liquid to be absorbed by a porous absorber so that the removal of the binder can be promoted while preventing occurrence of blistering and cracking. However, this method is rather impractical in consideration of the problems that (i) molded products tend to fail in withstanding their own weight during the degreasing step, resulting in collapse and that (ii) the progress of degreasing varies within a molded product similarly to the above case when the binder absorber is disposed in partial contact with the molded product, and as there are some requirements for arranging a plurality of molded products within a degreasing furnace, it is difficult to carry out stable degreasing to obtain a number of acceptable molded products free from deformation due to their own weight, blister and cracks.

There have been made proposals for overcoming the defects of the heat degreasing methods such as described above and the prolonged degreasing process. For instance, U.K. Patent No. 1516079 discloses that a molded product is formed with use of a binder composed of (i) a water-soluble polymer such as polyethylene glycol, polypropylene glycol and polyvinyl alcohol and (ii) a water-insoluble polymer such as polystyrene and polyethylene, and that the water-soluble polymer is preferentially extracted using water as a solvent and then the remaining polymer is removed for example by heating. One example disclosed in the above U.K. patent is such that a molded product produced with a binder comprising three components (i) polyethylene glycol (water-soluble polymer), (ii) polystyrene (to be extracted using methylene chloride as a solvent) and (iii) polyethylene (a strength component to be removed by heating) is first heated to a temperature equal to the melting point of polyethylene glycol or more. The water-soluble polymer is extracted using water as a solvent and then, the polystyrene polymer is extracted with methylene chloride. Thereafter, the molded product is further heated thereby finally removing the strength component, i.e., polyethylene from the molded product.

In this example, polyethylene that imparts strength to a molded product and can be extracted by a solvent is used in addition to polyethylene glycol because polyethylene glycol is poor in strength and use of it in large amounts weakens a molded product. This involves two solvent-extraction steps (one step is carried out with water and the other is with methylene chloride) and as a result, degreasing time cannot be satisfactorily reduced. Furthermore, use of an organic solvent such as methylene chloride is unavoidable which leaves financial problems as well as environmental problems to workers.

According to the above method, since water solvent extraction is performed by use of vapor heated to about 100° C. after the molded product is heated to a temperature equal to the melting point of polyethylene glycol or more, the molded product swells as the binder captures water. In addition, since polyethylene glycol has the properties of a water-soluble binding agent, the aqueous solution containing a high percentage of polyethylene glycol dissolved therein exhibits high viscosity and this disallows quick, uniform removal of polyethylene glycol from the entire surface of the molded product so that "sagging" similar to a sweating phenomenon is likely to occur. These defects lead to occurrence of cracking and deformation in the heat degreasing step which follows the water solvent extraction.

Techniques substantially identical to U.K. Patent No. 1516079 are disclosed in Japanese Patent Publication Laid-Open Nos. 2-101101 (1990), 2-182803 (1990), 2-182804 (1990) and 2-305903 (1990). As the water-soluble polymer typically used in powder molding which corresponds to polyethylene glycol, polypropylene glycol and polyvinyl alcohol of U.K. Patent No. 1516079, these publications use polyethylene glycol such as described in Powder Molding Hand Book (issued by The Nikkan Kogyo Shinbun Ltd. on Feb. 1987), macromolecular polyethylene oxides, methyl cellulose, carboxyl methyl cellulose (CMC), polyacrylamide and polyvinyl ether. They use a water-insoluble polymer such as polyethylene and polystyrene, like U.K. Patent No. 1516079.

More specifically, according to the above publications, a polyethylene oxide that is a high-molecular water-soluble polymer is used as a binder component in order to compensate for the weakness of the above-mentioned water soluble polymer, i.e., polyethylene glycol. After part or all of the polyethylene oxide is removed by water solvent extraction, most of the remaining polyethylene binder is removed by heating. Thermoplastic polyethylene oxides are, however, known to be poor in thermal stability. For example, when a binder containing a polyethylene oxide is mixed with a metal powder (SUS430c) by heating at 150° C., decomposition of the polyethylene oxide continuously takes place because of shear heat generated during mixing, so that stable mixing torque cannot be ensured. According to the result of a thermal analysis conducted on a binder which has been mixed with a powder material and kneaded until the mixture comparatively stabilizes, the temperature of the mixture drops from the average melting point (i.e., about 70° C.) of polyethylene oxides to about 54° C. that is equal to the melting point of polyethylene glycol. It can be assumed from this fact that most of the polyethylene oxide is changed to lower-molecular polyethylene glycol.

As described above, the methods of the above publications have difficulty in obtaining stable flowability in the mixed material and return row material and suffer from deterioration in the strength of the binder which is resulted from the decomposition of a polyethylene oxide. There are other problems which limit the shape of molded products to be produced, these problems including: variations in the weight of molded products caused by the unstable flowability of material; variations in dimensional accuracy after sintering; damage to products when taken out of molds owing to the decreased strength of the binder; and cracking of molded products during the step for cooling the inside of molds. Furthermore, the corners of molded parts are susceptible to collapse during the water solvent extraction because of the resistance of flowing water being gently agitated. During the water solvent extraction, molded products slightly swell throughout the entire area and swelling is considerable especially at their parting line sections. This is a fatal defect for some molded parts. Another problem is that the effects of raised temperature for increasing the rate of extraction cannot be expected, because the temperature of water in the water solvent extraction should be kept at about 50° C. or less in order to prevent "sagging" similar to a sweating phenomenon.

According to the above publications, the mechanism of the extraction is such that the water-soluble polymer at the surface of a molded product is first dissolved and diffused in water and at the same time, water penetrates into the molded product through the voids in which the dissolved water-soluble polymer has existed. The water-soluble polymer present in the vicinity of the void passages in the molded product is dissolved into the penetrating water and the water-soluble polymer thus dissolved then scatters in water that exists outside the molded product. The extraction rate for the water-soluble polymer in this process is discussed in connection with the relationship between the elementary process (I) where the rate of the movement/diffusion of the water-soluble polymer within the void passages of the molded product is controlled and the elementary process (II) where the difference in the concentration of the water-soluble polymer dissolved in the solvent between at the surface of the molded product and at the area remote from the above surface and the rate of the diffusion of the water-soluble polymer into the water solvent are controlled. It is known that polyethylene oxides, which are regarded as suitable water-soluble polymers in the publications, have good properties as high-viscosity water-soluble binding agents, and for instance, they are completely gelled in a 1 wt % aqueous solution at room temperature. For the reasons of (i) the properties of polyethylene oxides, (ii) the fact that the water-soluble polymer is dissolved at a high ratio in the vicinity of the surface of the molded product as illustrated in FIG. 8 of Japanese Patent Publication Laid-Open No. 2-182803 (1990) and (iii) the fact that the concentration of the polymer in the aqueous solution within the void passages of the molded product is thought to be at least equal to the concentration of the polymer at the surface of the molded product although this is not clearly stated in the publications, the water-soluble polymer moves and diffuses slowly during the elementary processes (I) and (II), resulting in a failure in archiving a satisfactory water solvent extraction rate. Known techniques for solving this problem are (i) a concentration controlling means is provided to keep the concentration of the polymer in the aqueous solution low; (ii) a sufficient amount of water is kept; and (iii) fluidization, agitation and vibration are imparted to the aqueous solution. The principle and system of extraction and lixiviation for wet refining are concretely described in "A New Metallurgical Course" New Version Refining Part (Chapter V: Non-Ferrous Metal Refining). This literature quantitatively explains the effect of agitation in the description relating to rates. Also, it is well known that highly viscous aqueous solutions containing a binding agent dissolved therein have such an inherent characteristic that their viscosity is decreased by agitation and fluidization. However, it should be noted that these promoting techniques are merely supplementary, because they leave much to solve. For instance, uniform extraction cannot be achieved even by agitation in molded products of some configurations particularly in their bores, groove bottoms and narrow drill holes. In cases where a plurality of molded products undergo multiple processes, there arises a problem in the arrangement of molded products. Further, rigorous agitation cannot be applied to light-weight molded products and to parts whose shapes are too unstable when they are placed in a furnace for degreasing. Therefore, there have been strong demands for the development of a binder composed of water-soluble substances that are capable of restricting the viscosity of an aqueous solution and it is desirable to use such a binder in combination with the above-described supplementary techniques in the degreasing process.

Of the above supplementary techniques, the fluidization of a water solvent can be attained by (i) splaying a water solvent on a molded product with a nozzle (Japanese Patent Publication Laid-Open No. 2-182803 (1990)); (ii) use of a conveying pump (Japanese Patent Publication Laid-Open No. 2-182804 (1990)); or (iii) use of ultrasonic waves (Japanese Patent Publication Laid-Open No. 2-182804 (1990)). These means are however rather infeasible in cases where a number of molded products are processed at the same time. In fact, it is very difficult in practical operation to set a number of molded products in relation to a nozzle and to bring a number of molded products in uniform contact with water fluidized by means of a conveying pump or ultrasonic waves. Further, these means cannot cope with the case where a plurality of kinds of molded products different in extraction time are continuously processed within the same water solvent extraction vessel.

Another method is disclosed in U.S. Pat. No. 4,197,118 in which a component, e.g., liquid oil is extracted with an organic solvent such as methylene chloride. This method, however, raises serious questions of safety and environmental problems. Further, the strength property of molded products is considerably degraded by use of a liquid oil so that molded products are susceptible to damage when taken out of molds, which limits the shape of molded products to be produced like other methods described earlier.

There are several problems in degreasing of an injection-molded product formed from metal powder. One of the problems is the amount of carbon remaining in the resultant degreased product which relates to the thermal decomposition of a binder. Another problem is cracking caused by the oxidation of the metal powder when degreasing is performed under an oxidation atmosphere. A further significant problem is variations in the sintering density of a sintered product. This is caused by a failure in adequately adjusting the components or carbon content of the sintered product. Some measures are reported to solve these problems, which are: (i) A choice of a suitable binder for injection molding; (ii) degreasing and composition adjustment carried out in an atmosphere of an $N_2$, Ar or $H_2$ gas; and (iii) adjustment of atmospheric gas during sintering. These methods are disclosed in Japanese Patent Publication Laid-Open Nos. 5-331503 (1993), 6-200303 (1994) and 6-73406 (1994).

As obvious from Japanese Patent Publication Laid-Open No. 7-305101, it is known that when degreasing is carried out under an atmosphere of an $N_2$ gas that is inactive for metal powder, the carbon content of sintered iron products considerably differs according to the maximum temperature in completion of degreasing as well as the composition of the binder used. In any cases, it is difficult to adjust the residual carbon content in an atmosphere of an inert $N_2$ gas or Ar gas. It is reported that when removal of a binder is carried out in the atmosphere, thermal decomposition of a thermoplastic binder is more accelerated with increasing temperature from 200° C., compared to the case of thermal decomposition degreasing under an $N_2$ gas atmosphere, but degreasing speed drops in the region after temperature reaches 250° C. because of formation of residual carbon, and that the formation of residual carbon creates internal stress, making the molded product more liable to cracking. It is also reported that if a metal powder susceptible to oxidation is used, an oxide is newly created on the surface of the metal, with the result that the molded product is expanded during degreasing and therefore more likely to crack.

Further, when degreasing is carried out in the atmosphere, the residual carbon content becomes substantially zero or oxygen remains as an oxide, or the amount of carbon originally contained in the metal powder decreases. Therefore, a troublesome adjustment is involved, that is, the carbon content of the sintered product has to be adjusted by carefully selecting the type of a powder to be used, the type of a binder to be used, compounding ratio, degreasing conditions and others.

Miura et.al. has proposed a method for adjusting the residual carbon content by carrying out degreasing in an atmosphere of an $N_2$ gas mixed with a $H_2$ gas at a high ratio.

It is also contemplated from the difference in the residual carbon content between the case of degreasing in an atmosphere of an $N_2$ gas and the case of degreasing in the atmosphere that the carbon content can be adjusted by mixing a flow of inert gas such as $N_2$ with air or oxygen. The details of one example of the above method are reported by "JOURNAL OF THE JAPAN SOCIETY OF Powder and Powder Metallurgy" (Vol.40, No.4,388). This method controls the carbon content by adding hydrogen to $N_2$ gas. According to this method, when degreasing is carried out at a temperature of 400° C. (this temperature is a very common degreasing condition), a large amount of hydrogen is required to be added to $N_2$ gas for controlling the carbon content, so that handling of hydrogen enriched gas to be taken out of the furnace is very dangerous. In consequence, it becomes necessary to control the evaporated and removed binder and employ a security system for preventing explosion. Another disadvantage is that the effect of $H_2$ gas for controlling the carbon content is small.

The method disclosed in Japanese Patent Publication Laid-Open No. 6-200303 suffers from similar problems.

In the method in which air or oxygen is directly added as disclosed in Japanese Patent Publication Laid-Open No. 5-331503, the carbon content of the degreased product is controlled by the direct reaction (this reaction is described by the following formula) between oxygen and carbon which starts to remain in the degreased product. The principle of this method differs from that of the above-described method in which hydrogen is utilized, and it is anticipated that with this method, the residual carbon content can be more effectively controlled compared to the hydrogen addition method.

$$C(S)+(1/2)O_2(G)=CO(G)[(S)\text{: solid, }(G)\text{: gas}]$$

$$G=-26{,}700-20.75T[T\text{: absolute temperature K}]$$

In reality, the direct oxidation reaction between oxygen and carbon is a violent exothermic reaction and particularly when oxygen is added into an inert gas such as $N_2$ in a slight amount, the reaction of oxygen proceeds more violently according to Le Chatelier's low. Therefore, when degreasing a number of molded products, this method has difficulty in controlling the carbon contents of a number of molded products so as to be uniform and cannot avoid the possibility of occurrence of cracks in molded products which are directly exposed to the introduced gas because of the excessive oxidation reaction. This is the case with the degreasing technique disclosed in Japanese Patent Publication Laid-Open No. 6-192706 (1994) wherein degreasing is performed under an atmosphere of oxygen-enriched air.

The present invention has been made taking the foregoing drawbacks into account, and one of the objects of the invention is therefore to provide a water solvent extraction degreasing method for removing a powder-injection-molding binder that is capable of reducing degreasing time without consideration of abrupt decomposition/vaporization and expansion caused by heat.

Another object of the invention is to provide a degreasing method comprising a water solvent extraction step for extracting a powder-injection-molding binder that is capable of reducing degreasing time while ensuring the shape retention of molded products during the degreasing step.

Another object of the invention is to provide a degreasing method comprising a step for economically, quickly and uniformly performing water solvent extraction on parts of various shapes with a simple system, such parts being formed from a stable, powder-injection-molding binder free from swelling and hydrolysis caused by water and aqueous solution components which are capable of restricting the viscosity of an aqueous solution extracted using water as a solvent.

Still another object of the invention is to provide a degreasing method for degreasing a powder-injection-molding binder that is excellent in strength and toughness in order to reduce injection molding and degreasing defects.

A further object of the invention is to provide a degreasing method in which the amount of residual carbon is adjusted during degreasing, whereby occurrence of defects in degreasing can be prevented and the amount of residual carbon in the resultant sintered product can be controlled.

DISCLOSURE OF INVENTION

The foregoing objects can be achieved by a water solvent extraction degreasing method according to the invention for degreasing an organic binder contained in a molded product formed by injection molding of a powder material mixed with the organic binder, wherein the organic binder is composed of a water-soluble organic binder component and a water-insoluble thermoplastic resin and wherein a degreasing step includes a water solvent extraction step for extracting the water-soluble organic binder component from the organic binder contained in the molded product with a solvent that contains water as its main component.

According to the invention, the water-soluble organic binder component is preferably composed of at least one substance selected from water-soluble amide compounds and water-soluble amine compounds. The water-insoluble thermoplastic resin is preferably a polyamide resin.

The thermoplastic water-soluble polymer such as polyethylene oxides which has been discussed in the description of the prior art is a thermoplastic polymer which is allowed to exhibit sufficient viscosity at a temperature equal to its melting point or more by forming as a high molecular material having high polymerization degree, that is, a molecular weight of from 50,000 to 5000, 000. When such a thermoplastic polymer is dissolved in water, it exhibits high stringiness, viscosity and adhesiveness as molecules are entangled with each other by virtue of the interaction between macromolecules having a wide range of molecular weights. As a result, the moving speed of molecules in a highly viscous state drops rapidly. Since the moving speed drops and the molecules in a moving unit are macromolecules, the diffusion property decreases. The main cause of the above-described problems in water solvent extraction is high molecularization which is, on the other hand, utilized in obtaining thermoplasticity and water solubility.

According to the invention, in order to solve this problem, water-soluble amide compounds and/or water-soluble amine compounds are used as the water-soluble component of the binder, these compounds having no thermoplasticity and a molecular weight of about 1,000 or less so that their polymerization degree can be substantially ignored. For providing the binder with the properties of a thermoplasticizer, a polyamide resin which has compatibility with the above water-soluble compounds and excellent strength and heat resistance is employed as the water-insoluble component of the binder. In addition, the water-soluble compound(s) of which polymerization degree can be substantially ignored does not cause thermal decomposition and therefore low molecularization when it is mixed with a powder material by heating, which allows the mixture material to flow stably, resulting in stable injection molding and solves the problem in reuse of runner and sprue material.

In the invention, it is considered desirable in view of solid solubility and diffusibility that time required for water-soluble extraction is reduced by making the temperature of the water solvent high. For this reason, the water-soluble organic binder component is rapidly extracted in the water solvent extraction step by immersing the molded product in the water solvent maintained at a substantially constant temperature. In this case, the molded product is preferably treated by water the temperature of which is controlled so as to be in the range of from the melting point of the water-insoluble thermoplastic resin to the glass temperature of the water-insoluble thermoplastic resin. It is to be noted that while an aqueous solution containing the above-mentioned water-soluble polymer generally tends to drop in viscosity within a high viscosity range, there are some cases where solvent extraction is infeasible because of gelation (e.g. in the case of CMC), apart from the problems of deformation and cracking caused by swelling and sagging similar to sweating.

In the invention, the degreasing problems mentioned above are solved by use of water-soluble amide compound (s) and/or water-soluble amine compound(s). By selecting water-soluble amide compound(s) and/or water-soluble amine compound(s) having a melting point from 50° C. to 190° C., uniform agitation, which cannot be obtained by external means, is achieved for parts of intricate shapes, utilizing the boiling effect of the compound(s) within hot water of 50° C. or more. Further, the invention incorporates other techniques as supplementary means, which are: agitation achieved by introducing gas into the water solvent from outside and by the boiling effect of the water solvent heated in an atmosphere of reduced pressure; and known mechanical techniques for causing a flow of water and agitation.

In the invention, the aforementioned outstanding subject of how to apply a uniform flow to a number of molded products is solved by actively moving the molded products within the water solvent in the process of water solvent extraction thereby to bring the molded products into more contact with the water solvent. Further, it is preferable that such movement of molded products be carried out in one or reciprocative circular direction. For example, molded products may be placed on a rotating plate which moves in circular motion and desired molded products may be arbitrarily taken out of the rotating plate while selecting according to their type and processing time, which enables it to perform continuous treatment on various types of molded parts different in extraction time. In addition, the water solvent is fluidized in the direction counter to the moving direction of the molded products and then in the same direction as the moving direction, whereby the degree of fluidization is more uniformly controlled.

The temperature of the solvent contained in molded products during the water solvent extraction may be first set to a temperature equal to the melting point of the water-soluble compounds and then increased as extraction proceeds up to the melting point of the polyamide resin or less. Since water solvent extraction at 100° C. or more can be easily carried out by heating at up to 2 atmospheric pressure within a commercially available, inexpensive pressure container, degreasing time and extraction cost can be further reduced.

In this case, the temperature of the water solvent can be easily and effectively decreased to about 100° C. by returning the applied pressure to the level of atmospheric pressure, and therefore molded products can be directly immersed into the binder when water-soluble amide and/or amine compound(s) having a melting point of 100° C. or more is used. This arrangement is desirable as it reduces extraction time.

The water-soluble amide compounds that can be used in the invention are substances each having amide groups while the water-soluble amine compounds are substances each having amine groups. It is preferable that one or more be selected from such water-soluble amide and amine compounds having melting points ranging from 50° C. to 190° C. and boiling points of 175° C. or more and used as the water-soluble binder component.

If water-soluble amide and/or amine compounds having melting points of less than 50° C. are used as the main component of the binder, the strength of the resultant molded products would deteriorate and the molding cycle would be prolonged. On the other hand, if their melting points exceed 190° C., the fluidity of the binder would be impaired, resulting in poor injection moldability. If their boiling points are below 175° C., they would preferentially evaporate from the binder during the process of mixing powder material with the binder or during the injection molding process, causing problems in the stability of injection molding and in the reuse of return material. 1 gram or more of these water-soluble substances is enough to be dissolved in 100 cc of water (this water may be in a heated state), but when higher extractability is required, it is necessary to dissolve 10 grams or more per 100 cc of water.

The water-soluble amide compounds contain amide groups and are classified into two groups according the presence or absence of benzene rings within their chemical structures. Examples of the water-soluble amide compounds having no benzene rings include: acetamide, propionic amide, alloxan (monohydrate), ethylurethane, ethyleneurea, glycolamide, heptanamide, methylacetamide, methylacetylurea, methyluracil (1)

$$(CO(CH)_2NHCON),$$

trimethylurea, and ethyl carbamate. Examples of the water-soluble amide compounds having benzene rings include: nitrobenzamide (o), nitrobenzhydrazide (o), phenylsemicarbazide (1) ($C_6H_5NHCO_2C_6H_5$), phenyl carbamate ester ($C_7H_7C_6H_4O_2CNH_2$), toluyl amide (o), toluyl amide (p), acetaminophenol, acetonaphthyl amide, and aminobenzamide (o). From the above-listed groups of amides having benzene rings and amides having no benzene rings, one or more may be selected for use as the water-soluble amide compound(s) of the invention.

The water-soluble amine compounds have amine groups and classified into primary amines and secondary amines. A representative example of the water-soluble amine compounds is N,N'-diacetylpiperazine (the secondary amine) which is prepared, for example, by dehydrocopolymerization of about one mol of hexahydropiperazine and about 2 mols of acetic acid with a customary method. Examples of the primary amines are aminodimethylaniline (p), aminopyridine (3) (β), aminoquinoline (2) (α) ($NH_2C_9H8N$), aminoquinoline (3) (β), diaminohydrazobenzene (p) ($(H_2NC_6H_4NH)_2$), hexamethylenediamine, histamine, menthylamine (1), naphthylamine (β), nitro-p-aminophenol (3), nitroaniline (o), nitrophenylhydrazine (p), nitrosoaniline (p), phenylaniline (p), phenylethylamine (β), phenylene diamine (m), toluylene diamine, toluylene diamine (1;2,4), toluylene diamine (1;2,5), triaminobenzene (1,2,3), triaminobenzene (1,2,4), and triethylenetetramine. Examples of the secondary amines are acetyl-p-phenylenediamine, aminopyridine (2) (a), diformylhydrazine ($(NHCHO)_2$), dipyridyl (4,4'), dipyridyl (3,3'), formylphenylhydrazine (β) ($C_6H_5NHNHCHO$), glucose phenylhydrazone ($C_6H_5NHN{=}C_6H_{12}O_5$), hydroxyethylethylenediamine ($HOCH_2CH_2NHCH_2CH_2NH_2$), hydroxypyridine, methylamino-p-hydroxybenzoic acid (3), methylbenzimidazole (2), methylglyoxalidine $$(CH_3C{=}N(CH_2)_2NH),$$

methylindole (2), nitrophenylhydrazine (p), phenylglycine (N) and triazole. From the above listed groups of the primary and secondary amines, one or more may be selected for use as the water-soluble amine compound(s) of the invention. The water-soluble amide compound(s) and water-soluble amine compound(s) may be used in combination.

As the water-soluble amide compounds and water-soluble amine compounds have amide groups and amine groups respectively, they are compatible with the polyamide resin which constitutes the binder. These water-soluble compounds preferably have melting points of 190° C. or less and boiling points of 175° C. or more. If their melting points exceed 190° C., the fluidity of the binder tends to be impaired and as a result, injection moldability is also impaired. If their boiling points are below 175° C., the water-soluble compounds tend to evaporate preferentially from the binder during the time when the binder is being mixed with metal powder material or during injection molding. This impairs the stability of the injection molding and makes it difficult to reuse the return material. 1 gram of these water-soluble compounds is enough to be dissolved in 100 cc of water, but high extractability can be achieved by 10 grams or more dissolved in 100 cc of water.

The preferable water-insoluble polyamide resin used in the water solvent extraction of the invention is composed of (i) a polyamide resin material having 8 or more carbon atoms between amide groups on average and (ii) an aromatic bisamide having 8 or more carbon atoms between amide groups on average, these substances (i) and (ii) being mixed at a substantially equal weight ratio. With this composition, the compatibility of the polyamide resin material with the water-soluble amide and/or amine compounds as well as its water absorbency can be improved, thereby preventing swelling during the water solvent extraction.

Examples of the aromatic bisamide include: xylylene bisstearic acid amide, N,N'-distearyl isophthalic acid amide, and N,N'-distearyl terephthalic acid amide. It is preferable that one or more be selected from the above substances.

The water-insoluble polyamide resin for the water solvent extraction of the invention may be composed of one or more kinds of polyamide resin materials having 10 or more carbon atoms between amide groups on average. The main structure of each polyamide resin material is a normal chain chemical structure so that the water absorbency of the polyamide resin material can be improved, thus preventing swelling during the water solvent extraction.

A preferable polyamide resin material is obtained from copolycondensation of: (1) $C_{36}$-dimeric acid, $C_{44}$-dimeric acid, or a mixture of $C_{36}$-dimeric acid and $C_{44}$-dimeric acid; (2) aliphatic dicarboxylic acid having 6 to 1(carbon atoms; (3) xylylenediamine; and (4) ethylenediamine and/or hexamethylenediamine. In this case, the average molecular weight is preferably 20,000 or more.

The major component of a preferable polyamide resin material may be nylon 11 and nylon 12. In this case, the average molecular weight is preferably 13,000 or more.

Such nylon 11 and nylon 12 may be prepared, for example, by dehydro-condensation of (ω-aminoundecanoic acid and ω-aminolauric acid. The polyamide resin material having 8 carbon atoms or more on average between amide groups and containing nylon 11 and nylon 12 as a major component may be prepared by copolymerization of nylon 11 and nylon 12 with other nylons such as nylon 2, 36, nylon 2, 44, nylon 6, nylon 6, 8, nylon 6, 10, nylon 6, 36, nylon 6, 44 and ether.

There are commercially-available materials which can be used as the components of the polyamide resin material. For instance, examples of the nylon 12 are "Daiamide A1709P" and "Daiamide L1724K" produced by Daicel Huels Ltd. An example of the nylon 12-ether copolymer is "Daiamide E40S3" produced by Daicel Huels Ltd. and "PEBAX5533SN01" produced by TORAY.

The water used in the water solvent extraction step of the invention is preferably in the state of shower or steam.

The method of the invention may include a heat decomposition removing step in which the residual binder remaining after the extraction of the water-soluble organic binder component in the water solvent extraction step is decomposed by heat and removed. As there have been formed many paths in the molded product by the water solvent extraction, large quantities of gas generated by the decomposition and vaporization of the water-insoluble polyamide resin during the heat decomposition removing step can escape through the paths so that it would not be a cause of swelling and cracking. Accordingly, heating in a later step, i.e., a heat decomposition degreasing step may be performed in the atmosphere. There is the danger, however, of cracking in cases where a metal powder susceptible to oxidation is used, because an oxide film may be formed by oxygen in air or internal stress is generated by carbonization reaction lead by dehydrogenation. Further, when degreasing is carried out in the atmosphere or when oxygen is directly added, it is sometimes difficult to control the amount of carbon remaining in degreased products or products obtained by sintering after degreasing.

In order to solve these problems, the invention is designed such that:

(1) formation of an oxide film is prevented by carrying out the heat decomposition and the removal by vaporization in an atmosphere of inert gas such as $N_2$ or Ar; gas expansion during vaporization is reduced by allowing a lubricant and the polyamide resin to vapor in a situation in which the organic material is decomposed in a large molecular weight unit; and occurrence of degreasing defects is reduced by restricting carbonization reaction, and/or (2) utilizing the fact that the oxidizing reaction [$C(S)+CO_2(G) = 2CO(G)$] between carbon dioxide gas and carbon remaining in molded products even at about 700° C. (this is the final heating temperature of the customary binder removal) in the course of binder removal is an endothermic reaction, carbon dioxide gas is introduced into inert gas such as $N_2$ gas, thereby to promote oxidation according to Le Chatelier's Low and to create a moderate oxidized atmosphere, so that the residual amount of carbon can be more positively controlled and cracking caused by the excessive oxidation or excessive carbonization of the binder can be prevented.

As the concentration of the binder in the molded products after the water solvent extraction is comparatively low and as gasification of the binder can be substantially controlled by introducing $CO_2$ into the heating atmosphere, the molded products are directly heated under atmospheric pressure or reduced pressure in an atmosphere of $N_2+CO_2$ or $CO_2$ in the sintering step which follows the water solvent extraction step, until about 800° C. is reached. After reaching 800° C., the molded products are sintered in air or in an atmosphere of vacuum, reduction, or inertness, thereby achieving further reduction of degreasing time.

The preferable composition of the organic binder used in the molded products is 20 to 80 wt % the water-soluble amide compound(s) and/or water-soluble amine compound (s) and 20 to 65 wt % the polyamide resin. Since the water-soluble amide compound(s) and/or the water-soluble amine compound(s) are contained in large amounts in this composition, degreasing by a water solvent plays a major part in the degreasing step. This lessens the proportion of heat degreasing process which takes more time, and in consequence, degreasing time can be reduced. Since the volume of the escaping paths created by the water solvent extraction takes up considerable space in the molded product and since the amount of portion to be degreased by heating is small, there is substantially no need to consider abrupt decomposition, vaporization and expansion caused by the heat of the binder. Therefore, heat degreasing speed can be increased, which consequently saves 80% or more of the total degreasing time required by the conventional heat decomposition degreasing method.

If the amount of the water-soluble amide and/or amine compound(s) is less than 20 wt % for the total amount of the binder, swelling and deformation could not be prevented in the subsequent heat degreasing step and the water solvent extraction would take a long time. Therefore, the amount of the above compound(s) should be 40 wt % or more in order to save total degreasing time and prevent occurrence of degreasing defects in the subsequent step. If the amount exceeds 80 wt %, the molded products decrease in strength so that it becomes difficult to take the molded products out of molds, although such difficulty also depends on the shape of the molded products. The preferable amount of the water-soluble compound(s) is 45 to 60 wt %. It should be noted that the substantially same effect can be obtained irrespective of whether one or two substances are selected for use from the above-listed groups of water-soluble amide and amine compounds. Although it can be contemplated to use liquid substances such as dimethylformamide and dimethylacetamide, these substance cause a decrease in the strength of the binder, so that the shape of molded products is limited when they are used. In consideration of the strength of molded products and reduction of total degreasing time by the water solvent extraction, it is preferable that the amount of the water soluble compound(s) be 40 to 70 wt % and the amount of the polyamide resin component be 25 to 45 wt %.

It has been found in the case of the conventional polyethylene oxide type binder that defects such as swelling and sagging similar to sweating are likely to occur during water solvent extraction, when the temperature of the solvent in the water solvent extraction is equal to the melting point of the water-soluble compound or more, whereas the binder containing the water-soluble amide and/or amine compound (s) according to the invention has achieved a desirable result free from sagging even when the temperature of the water solvent exceeds the melting point of the water-soluble compound(s). The reason for this resides in that polyethylene oxides are high-molecular water-soluble polymers as stated earlier so that they exhibit considerable swelling property relative to water and extremely high viscosity when they are dissolved, while the water-soluble amide and/or amine compound(s) of the invention has a molecular weight of about 1,000 or less so that it exhibits no swelling property in relation to water because of its extremely high solid solubility relative to water and exhibits low viscosity at the time of dissolving. Moreover, the water-soluble amide and/or amine compound(s) is quickly carried away from the surfaces of the molded products by the agitation effect of the convection and boiling of water at 50° C. or more. To ensure high extractability, the temperature of the water solvent for the binder containing the water-soluble amide and/or amine compound(s) should be increased from room temperature to the melting point (i.e., 50° C. or more) and water-soluble extraction temperature can be increased by setting the temperature of the water solvent to 70° to 100° C. or more. The boiling/convection phenomenon of the water solvent under the above temperature condition may be effectively, actively utilized to achieve an agitation effect over the entire surface of the molded products. This enables rapid, uniform extraction unaffected by loading arrangement when a number of molded products are processing at the same time.

With the agitation effect, the extractability of the invention can be more improved than that of the conventional extraction where polyethylene glycol or polyethylene oxide is extracted at a temperature of 50° C. or less. This effect is remarkable particularly when using diacetyl piperazine whose melting point has been found to be about 124° C. from a thermal analysis of a binder. In this case, the solid solubility increases and the remarkable agitation effect can be achieved by a water solvent such as boiling water of about 100° C, superheated steam of 100° C. to 120° C. or hot water heated under pressure, so that the extraction can be speeded up and degreasing time can be reduced. In addition, the amount of used water can be reduced, the water solvent extraction system can be made in a compact size, and substantially all the amount of the water-soluble compound (s) can be extracted in a short time.

In view of safety in all aspects (since the amount of the water-soluble amide and/or amine compound(s) contained in the binder of the invention is 80 wt % maximum, there are some possibilities of deformation due to the liquefaction of the water-soluble compound(s) when extraction is started with a water solvent temperature equal to or more than the melting point of the water-soluble compound(s)), the preferable method of the invention is such that: the temperature of the water solvent is set to a temperature less than or equal to the melting point of the water-soluble compound(s), and after the molded products have been immersed in the water solvent, the temperature of the water solvent is increased to the melting point or glass temperature or less of the polyamide resin (which is a strength component of the binder) with the ambient pressure being adjusted, while the water-soluble compound(s) is extracted from the surfaces of the molded products. It should be noted that water solvent extraction at 120° C. or more requires an expensive system capable of withstanding high pressure and increase the swelling property of the polyamide resin. Taking this into account, the preferable temperature of the water solvent is 120° C. or less.

Since the aqueous solutions of the water-soluble amide and/or amine compound(s) according to the invention have low viscosity, heated steam may be used in place of heated water.

The amount of the water-soluble amide and/or amine compound(s) may be increased to approximately 40 to 80 wt %, by which heat degreasing time can be further reduced and the molded products are allowed to be heated in an atmosphere of a mixture of $N_2$ (inert gas) and $CO_2$ gas or an atmosphere of $CO_2$ in the region of up to about 800° C. in the sintering step and then sintered in an atmosphere (e.g., vacuum, reduction, inertness or the atmosphere) suited for the used powder material in the subsequent region of more than 800° C. This substantially eliminates the need for a presintering step, that is, a heat degreasing process, and further reduces degreasing time in consequence.

In the invention, it is preferable to use a lubricant by 15 wt % or less. As the lubricant, fatty acid amides and N-substitution fatty acid amides which do not have a swelling property and have a normal chain system as their main chemical structure are preferable in view of their binding strength.

In the polyamide-type binder of the invention, the weight ratio of the water-soluble amide and/or amine compound(s) can be largely increased by compatibilizing (i) a polyamide resin which is made from $C_{44}$ dimeric acid and $C_{36}$ dimeric acid and has 8 or more carbon atoms on average between amide groups or a polyamide resin which contains nylon 11, 12 as a major component and has 8 or more carbon atoms on average between amide groups with (ii) xylylene bis stearic acid amide or the like. Further, swelling of the molded products caused by water entrapment during the water solvent extraction as well as occurrence of cracking during the subsequent heat degreasing step can be perfectly prevented by improving the molded products in terms of its mold release property and water absorbency by partial crystallization of the polyamide resin. Thus, the water solvent extraction degreasing method of the invention considerably saves degreasing time compared to the conventional heat decomposition degreasing method and is applicable to a wide variety of parts including: parts susceptible to deformation during degreasing; parts susceptible to internal defects that are thought to occur during heating in a heat decomposition degreasing step (e.g., metal materials and ceramics); parts formed from high specific gravity metal materials such as tungsten; and large-sized, thick parts.

While the quantity of the polyamide resin used is 20 wt % or more with respect to the weight of the binder, it is preferable to use 25 wt % or more of the polyamide resin in order to retain a metal powder material of comparatively high specific gravity (such as iron, copper, nickel, tungsten or cemented carbide) within an injection-molded product. If the quantity of the polyamide resin is less than 25 wt %, there is the danger of damage to the molded products when taken out of molds after injection molding or when handling. The quantity of the polyamide resin should be 60 wt % or less relative to the weight of the binder. Although the maximum amount of the aromatic bisamide contained as a compatibilizer in the polyamide resin is possibly 70 wt %, the preferable amount of the aromatic bisamide is less than that of the polyamide resin material on weight basis because when the aromatic bisamide and the polyamide resin material are contained in an equal amount, the molded products will be hardened and therefore susceptible to damage during molding.

Molded products formed from a carbonyl iron powder material were heat-degreased in an atmosphere of a mixture gas of $N_2$+$CO_2$ and then vacuum sintered to prepare sintered products which were checked in terms of residual carbon content and cracks created. It was found from the check that as the mixture ratio of $CO_2$ increases, the carbon content decreases thereby achieving more controllability. It was also found that sintered products obtained from sintering after degreasing were free from cracks attributable to formation of oxides.

The molded products of the invention are formed bad degreasing with the above-described degreasing method. The molded products of the invention are excellent in strength and toughness and free from degreasing defects.

BRIEF DESCRIPTION OF DRAWINGS

FIG. 1 is a sectional view of a molded product a.

BEST MODE FOR CARRYING OUT THE INVENTION

Figure 1:
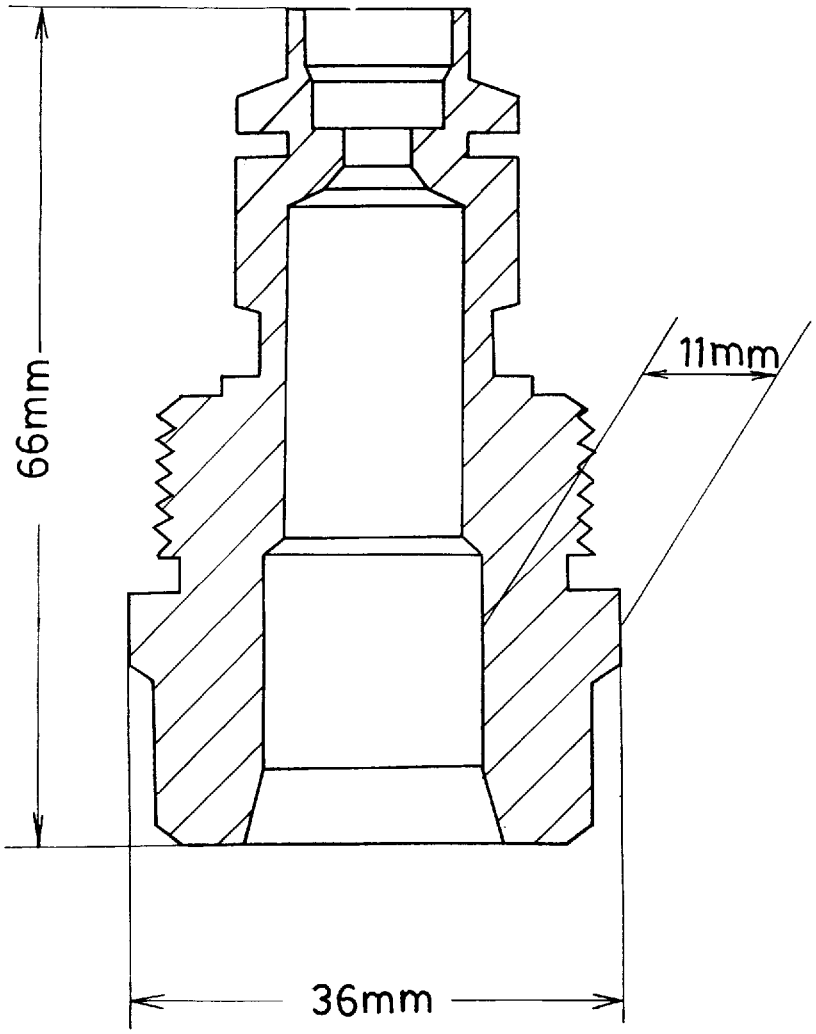

Now, there will be given a detailed explanation on examples of a degreasing method according to the invention for degreasing powder injection molded products that are formed with a binder containing water-soluble amide and/or amine compound(s) and their comparative examples.

(A) Binder Composition 13 mols of $C_{44}$-dimeric acid ("PRIPOL 1004" produced by Unichema International), 7 mols of azelaic acid ($C_7$-dimeric acid), 7 mols of ethylenediamine and 13 mols of xylylenediamine were mixed and dehydro-copolycondensated to prepare a polyamide resin (1) having an average molecular weight of about 50,000. The chemical structure of this polyamide resin (1) was adjusted such that the average number of carbon atoms present between amide groups was about 17.5.

$C_{36}$-dimeric acid ("PRIPOL 1013" produced by Unichema International), azelaic acid, ethylenediamine and xylylenediamine were mixed at an equal molecular ratio and dehydro-copolycondensated to prepare a polyamide resin (2) having an average molecular weight of about 40,000. The average carbon number between amide groups of this polyamide resin (2) was 12.2.

As an representative example of the nylon resin, a commercially available nylon 12/ether elastomer copolymer ("PEBAX5533NO1" produced by TORAY) was used.

1 mol of piperazine and 2 mols of acetic acid were mixed and dehydro-copolycondensated, thereby preparing N,N'-diacetylpiperazine (melting point=140° C.). N,N'-ethylene bis stearic acid amide (melting point=about 145° C.), N,N'-ethylene bis lauric acid amide (melting point=about 157° C.), N,N'-xylylene bis stearic acid amide (melting point=about 123° C.), acetamide (melting point=about 82° C.), and ethyl carbamate (melting point =about 48° C.), which were used herein, are all commercially available. The above substances were melted and mixed at the weight ratios shown in Table 1 and pulverized after cooling, thereby to prepare Binders A to I.

For the purpose of comparison, Binders J and K having known compositions as shown in Table 2 were prepared. The compositions of Binders J and K are disclosed in U.S. Pat. No. 5002988 and Japanese Patent Publication Laid-Open No. 2-101101 (1990), respectively. As the polyethylene oxide constituting Binder K, PEO-18 (produced by Sumitomo Seika Chemicals Co., Ltd.: molecular weight=4000,000 to 5000,000) was used. PEO-18 is a thermoplastic substance and thought to impart great strength to molded products.

TABLE 1

| | POLY-AMIDE RESIN (1) | POLYAMIDE RESIN (4) | NYRON 12/ ETHER (PABEX) | XYLYLENE BIS STEARIC ACID AMIDE (PXS) | ETHYRLENE BIS LAURIC ACID AMIDE | ETHYRLENE BIS STEARIC ACID AMIDE | N,N-DIACETYL-PIPERAZINE (MP: 141° C.) | ACETAMIDE (MP: 82° C.) | ETHYL CARBAMATE (MP: 48° C.) |
|---|---|---|---|---|---|---|---|---|---|
| A | | 35 | | 10 | | | 55 | | |
| B | | | 35 | | | 5 | 60 | | |
| C | 35 | | | | 10 | | 55 | | |
| D | | | 25 | | | 5 | 70 | | |
| E | | | 20 | | | 5 | 75 | | |
| F | | | 75 | | | 5 | 20 | | |
| G | | | 55 | | | 5 | 40 | | |
| H | | | 35 | | | 5 | | 55 | |
| I | 35 | | | | | 5 | | | 55 |

FOOT NOTE:
MP = MELTING POINT

TABLE 2

| | | | |
|---|---|---|---|
| J | POLYAMIDE RESIN (4) 45 wt % | ETHYLENE BIS LAURIC ACID AMIDE 25 wt % | N,N-DIACETYL-PIPERAZINE 30 wt % |
| K | POLYETHYLENE 34 wt % | STEARIC ACID 11 wt % | POLYETHYLENE OXIDE 55 wt % |

(B) Extractability of water-solvent extraction performed on molded products.

Figure 2:
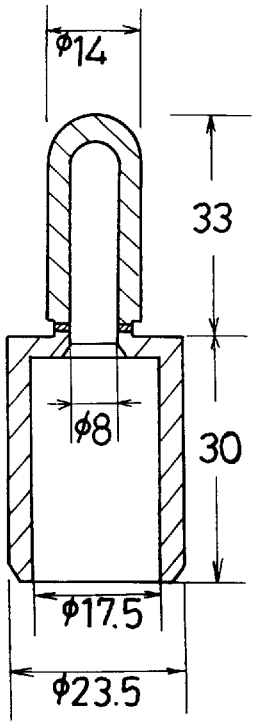
FIG. 2 is a sectional view of a molded product b.

10.5 parts of Binders A to I and J, K were respectively added to 100 parts of stainless steel fine powder (SUS430, average particle diameter=10 microns) produced by the water-atomizing method and the mixtures were kneaded while heating at 150° C. Then, these mixtures were cooled and pulverized to prepare injection molding materials. Under the injection molding conditions (injection temperature=140° C., pressure=approximately 700 kgs/$cm^2$), molded products a and b as shown in FIGS. 1, 2 were prepared from the respective molding materials. The molded products a each had a weight of about 130 grams and maximum thickness of 11 mm and were very large in size as parts to which the injection molding technique was applicable. The molded products b each had a weight of 50 grams and maximum thickness of 4 mm, and were comparatively thin.

When mixing Binder K containing the water-soluble polyethylene oxide with the above powder, the mixing condition was checked using a "Plastograph" (produced by Shimadzu Corp.) and it was found that the mixing torque was very unstable. Therefore, the mixture obtained after mixing for 1.5 hours and PEO-18 were both subjected to a thermal analysis. From the analysis, it was found that PEO-18 was low-molecularized while being thermally decomposed during heat-mixing so that its melting point dropped to that of polyethylene glycol. For this reason, injection molding temperature was set to 125° C. for this sample.

Regarding the molded product a prepared with Binder K, although filling defects were found and a fine skin layer was peeled off in the thread section and the occurrence of burrs was remarkable at the parting section, the molded product a was polished with a brush and used in the subsequent extraction test. When preparing the molded product b by use of Binder K, density defects occurred frequently and the neck section (see FIG. 2) was broken considerably so that an acceptable molded product could not be obtained.

Figure 3:
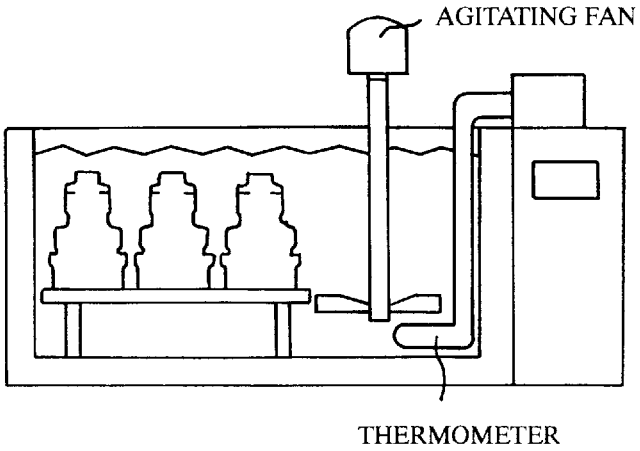
FIG. 3 is a schematic view of a thermostatic bath for use in water solvent extraction.
Figure 4:
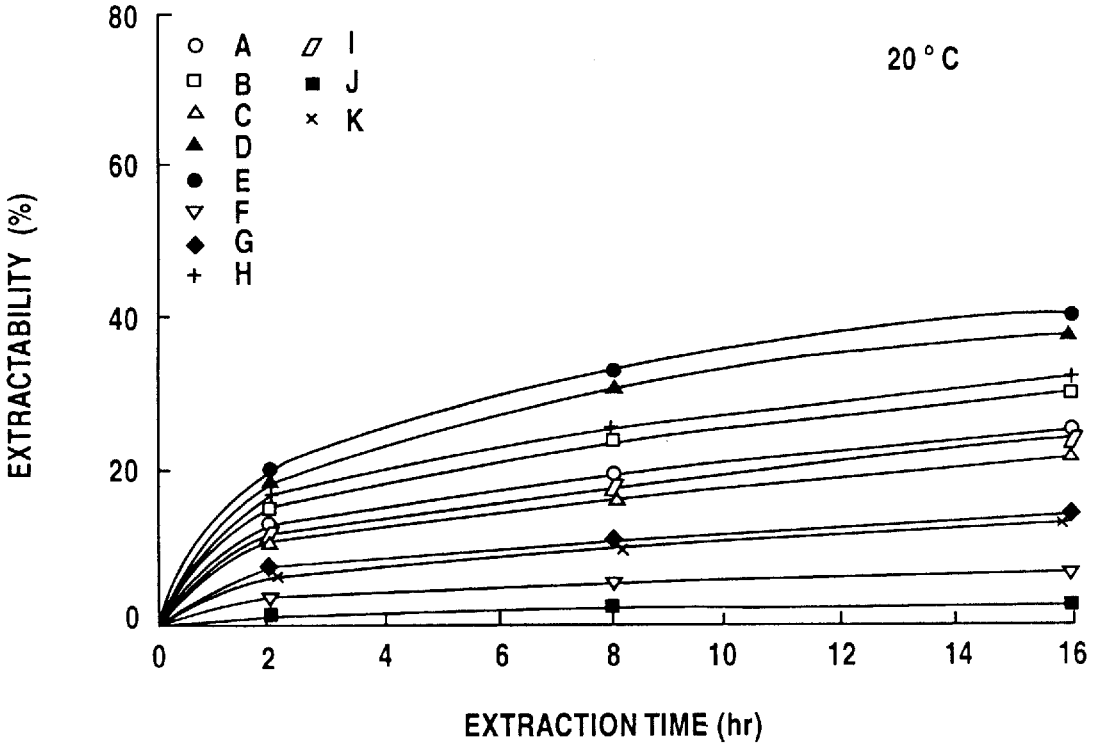
FIG. 4 is a graph showing the result of a test for checking the extractability of extraction performed on the molded products a at 20° C.

FIG. 3 schematically shows a system used in the following extraction tests. This system is a commercially available thermostatic bath equipped with an agitator for keeping the inside of the bath at a constant temperature. A test was conducted in the following way: First, the molded products a as shown in FIG. 1 were immersed for a specified time in a water solvent the temperature of which was constantly kept at about 20° C. by gentle agitation. Then, the products a were dried at 70° C. over 2 hours with a hot air dryer. From the change in the weight of each molded product, extractability 1 in the extraction of each water-soluble binder component [(the weight percentage of an extract/the weight percentage of a binder contained in a molded product)×100] was obtained to evaluate water solvent extraction speed. The result is shown in FIG. 4. Regarding Binders A to E, H, and I, extractability 1 exceeded 20% in some period of time during the 16-hour extraction experiment and it is therefore admitted that the extraction speeds of these cases are fairly high. In the comparative example where Binder J was used, substantially no extractability was admitted. In the case of Binder K containing the same amount of the polyethylene oxide, extractability was noticeable, but the extraction speed was obviously low compared to the cases of the binders containing the water-soluble amide and/or amine compound (s) according to the invention. Swelling slightly occurred in the molded product prepared with the binder K after extraction at 20° C. for 16 hours and particularly, its die-parting line section was considerably swollen.

Figure 5:
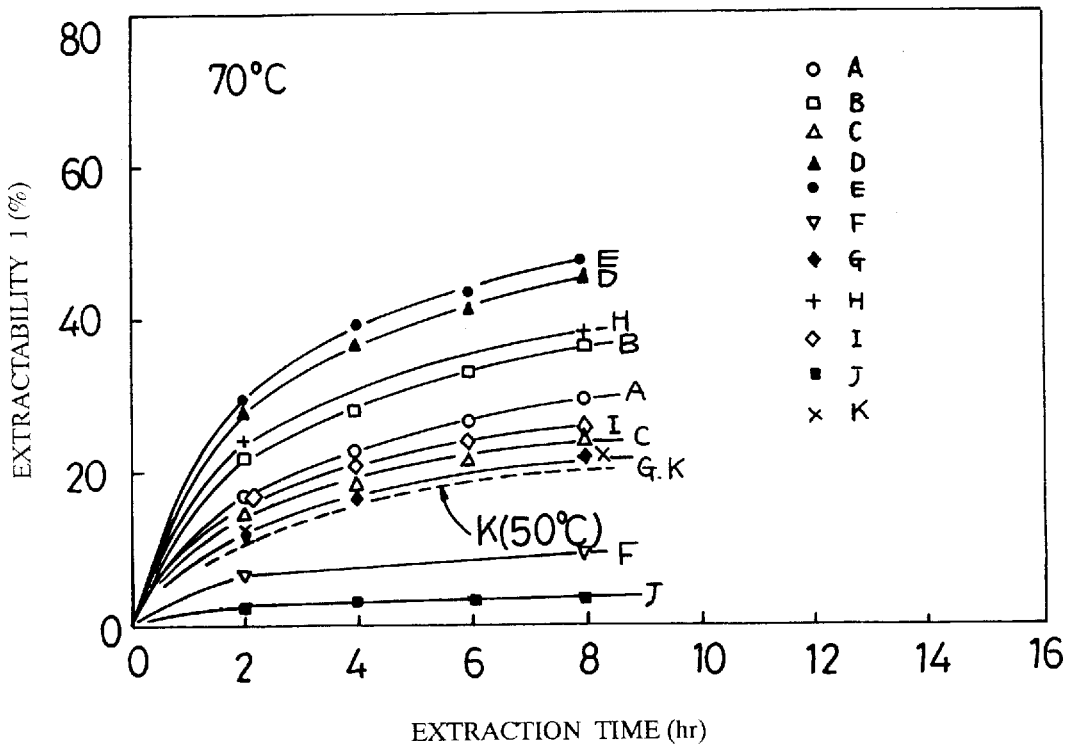
FIG. 5 is a graph showing the result of a test for checking the extractability of extraction performed on the molded products a at 70° C.

FIG. 5 shows the result of another test conducted to check extractability in extraction for removing each water-soluble binder component under the gently agitating condition similar to the first extraction test, with the temperature of the water-solvent being increased to 70° C. to enhance extractability. In the second extraction test, there was found virtually no extractability in the case of Binder J. In the case of Binder K, considerable swelling was admitted after two-hour extraction as well as after eight-hour extraction and sagging similar to the sweating phenomenon had also occurred. In consideration of the melting point (54° C.) of the polyethylene oxide contained in Binder K which has been found from the above-mentioned thermal analysis and of the extraction temperature stated in Japanese Patent Publication Laid-Open No. 2-101101 (1990), the temperature of the water solvent was set to 50° C. and an extraction test for Binder K was conducted under the same agitating condition as described earlier. FIG. 5 shows the result of this extraction test. Although no sagging occurred, occurrence of swelling was admitted. It was found that as the temperature of the water solvent increases, swelling occurred to a higher degree.

After the extraction test at 70° C. had been conducted, the molded products were dried and heated over 8 hours in an atmosphere of $N_2$ gas within a hot air circulating furnace the temperature of which was elevated from room temperature to 350° C. so that the residual binders were decomposed and evaporated. The products thus obtained were checked in terms of degreasing defects. Table 3 shows the checking result.

TABLE 3

| | PRESENCE/ABSENCE OF DEGREASING DEFECTS AFTER HEAT DECOMPOSITION DEGREASING | | | | | | | | | | | |
|---|---|---|---|---|---|---|---|---|---|---|---|---|
| | EXTRACTION TIME $2^H$ | | | $4^H$ | | | $6^H$ | | | $8^H$ | | |
| A | ○ | ○ | ○ | ○ | ○ | ○ | ○ | ○ | ○ | ○ | ○ | ○ |
| B | ○ | ○ | ○ | ○ | ○ | ○ | ○ | ○ | ○ | ○ | ○ | ○ |
| C | ○ | ○ | ○ | ○ | ○ | ○ | ○ | ○ | ○ | ○ | ○ | ○ |
| D | ○ | ○ | ○ | ○ | ○ | ○ | ○ | ○ | ○ | ○ | ○ | ○ |
| E | ○ | ○ | ○ | ○ | ○ | ○ | ○ | ○ | ○ | ○ | ○ | ○ |
| F | x | x | x | x | x | x | x | x | x | x | x | x |
| G | x | x | x | x | x | x | ○ | ○ | ○ | ○ | ○ | ○ |
| H | ○ | ○ | ○ | ○ | ○ | ○ | ○ | ○ | ○ | ○ | ○ | ○ |
| I | ○ | ○ | ○ | ○ | ○ | ○ | ○ | ○ | ○ | ○ | ○ | ○ |
| J | x | x | x | x | x | x | x | x | x | x | x | x |
| K | x | x | x | x | x | x | x | x | x | x | x | x |

In the cases of Binder J and K, there occurred large cracks in the degreased products which had undergone 8-hour water solvent extraction. Large cracks were also created in the products formed from Binder K which had undergone 8-hour extraction at 50°. Cracks were remarkable particularly in the parting line section, but many cracks were also found in other thick areas. From the fact that more cracks were found in thick areas than thin areas and that the diameter section was cracked considerably, it is understood that the causes of cracks are deeply associated with insufficient water solvent extraction, extraction that is nonhomogeneous between the internal and external diameter areas of a molded product, and swelling. Deformation and cracks were found in the degreased products of Binders F, G which had undergone short-time water solvent extraction, because the water-soluble compounds were contained in small amounts. In the case of Binder I containing the water-soluble compounds having melting points of less than 70° C., the products were free from sagging that was admitted in the case of Binder K and neither cracks nor deformation occurred. It is understood that the molded products of Binders A to I can be degreased without defects under the following heat degreasing conditions, provided that about 15 to 20 wt % of the water-soluble compounds have been extracted in the water solvent extraction.

Figure 6:
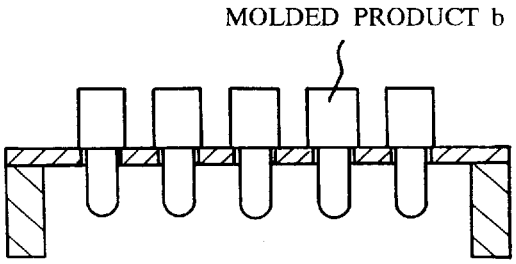
FIG. 6 is a view of the molded products b as being immersed in a water solvent in an extraction system.
Figure 7:
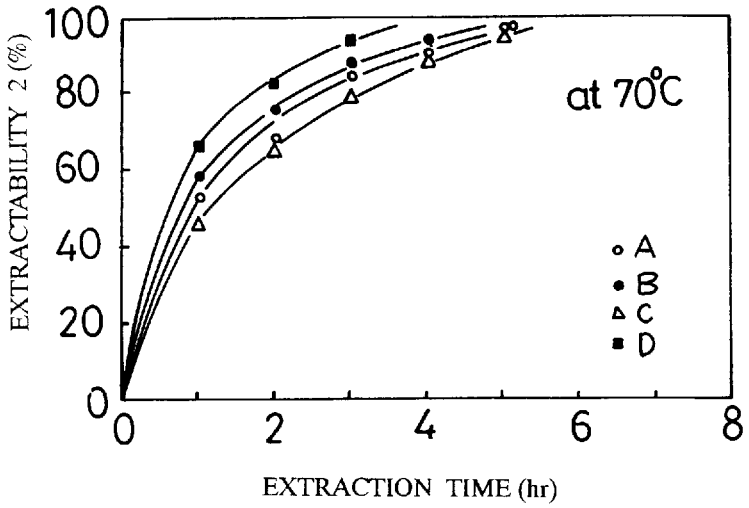
FIG. 7 is a graph showing the result of a test for checking the extractability of extraction performed on the molded products b at 70° C.

Next, the molded products b formed by use of Binders A to D were immersed in the manner as shown in FIG. 6 in a water solvent kept at 70° C., using the same system as employed in the above tests. Then, extractability 2 [(the weight percentage of an extract/the weight percentage of water-soluble compound(s) constituting a binder contained in a molded product)×100] was checked for each case of extraction. FIG. 7 shows the result of the test. It is understood from FIG. 7 that about more than half (i.e., 55 to 60%) of the water-soluble compounds was extracted by one-hour immersion and 90% of the water-soluble compounds was extracted by about three-hour immersion in each case. This means that uniform extraction can be performed on a deep hole formed in a part like the molded product b by the gentle agitation such as carried out herein. In a heat degreasing furnace, the molded products which had undergone one-hour water solvent extraction were degreased by heating to 350° C. at a programming rate of 3° C./min in an atmosphere of $N_2$ gas. The degreased products thus obtained were all acceptable products. It is assumed from the result of heat-degreasing of the molded products a that the molded products b can achieve the original purpose after extraction for 30 minutes. When considering the fact that while it takes about 50 to 60 hours to degrease the molded products b by the conventional heat degreasing method, the method of this embodiment requires only about 4 hours, it is understood that the invention has accomplished sensational effects.

Figure 8:
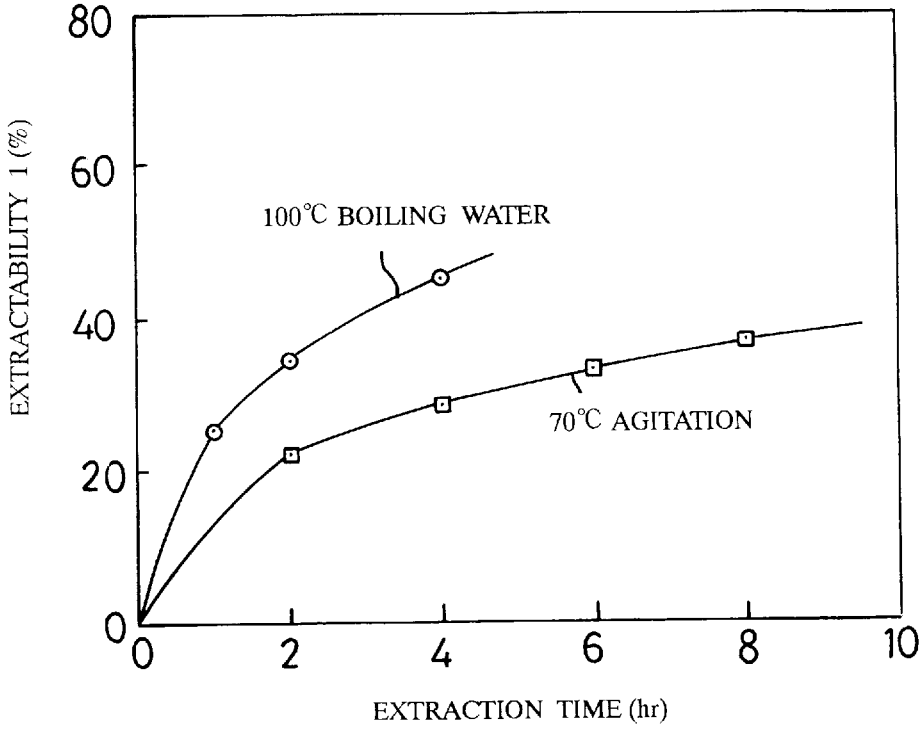
FIG. 8 is a graph showing the result of a test for checking the extractability of extraction performed on the molded products a in boiling water.

The molded product a formed by use of Binder B was immersed in a water solvent boiled at 100° C. in a thermostat bath having no agitator and extractability 1 was checked. FIG. 8 shows the test result. Extractability in this case significantly increased compared to the case of extraction at 70° C. in the agitating condition and the amount of extract produced after one-hour extraction in the above boiling condition substantially corresponds to the amount of the extract of about 4-hour extraction at 70° C. in the agitating condition. This molded product a which had undergone the one-hour extraction was degreased by heating under the conditions described before and the resultant degreased product was found to be free from any defects.

Figure 9:
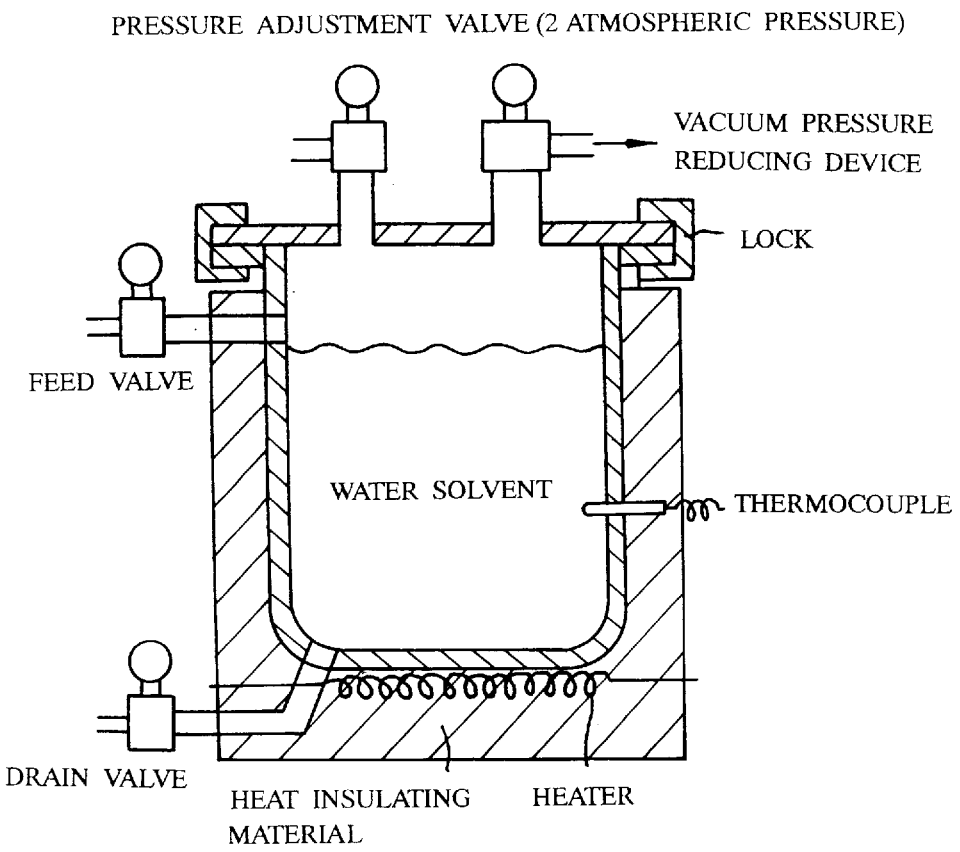
FIG. 9 is a sectional view of a solvent vessel for use in pressurized heating and depressurized heating.
Figure 10:
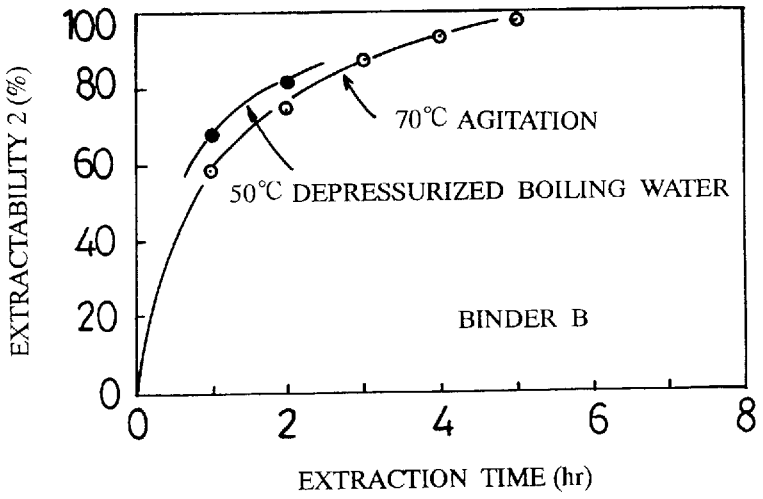
FIG. 10 is a graph showing the result of a test for checking the extractability of extraction performed on the molded products b in depressurized boiling water of 50° C.

Then, the molded products b formed by use of Binders B and C were immersed in a water solvent, using a solvent vessel as shown in FIG. 9 which was capable of carrying out depressurized heating and pressurized heating. While the solvent being boiled at 50° C. and 0.3 atmospheric pressure, extractability 2 was checked for the molded products b of Binders B and C. FIG. 10 shows the test result. The respective extraction speeds of these cases were found to be higher than the cases where the same samples underwent extraction at 70° C. in the gentle agitating condition. This increase in extraction speed is due to the significant agitating and convection effects of boiling.

It is assumed from the above experiments where extraction was carried out in the heating/boiling condition that extraction can be significantly promoted by blowing gas such as air into the solvent vessel and this arrangement makes the system compact.

Figure 11:
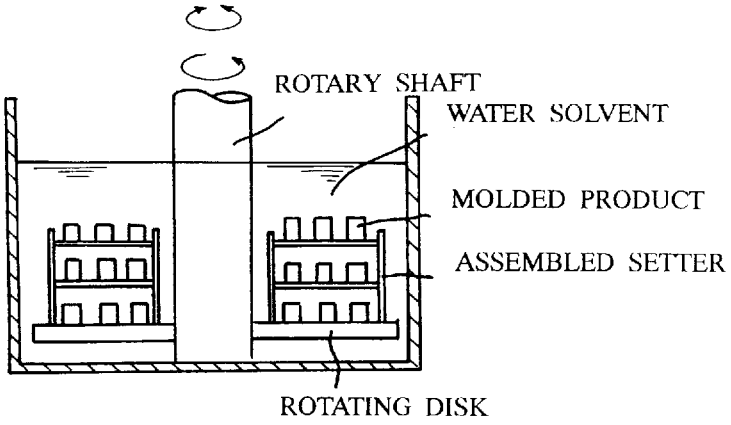
FIG. 11 is a sectional view of an apparatus for moving molded products.
Figure 11:
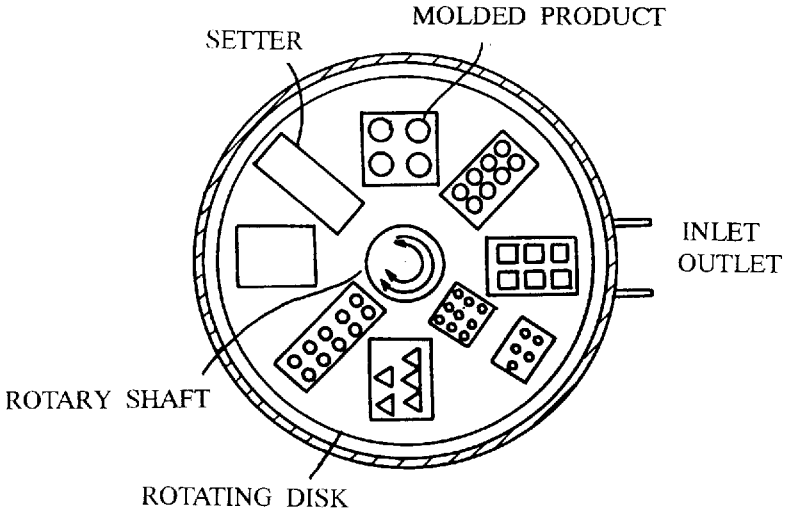

FIG. 11 shows a system in which molded products placed on a rotating disk are moved in one or reciprocative circular direction while a water solvent being transferred in the direction counter to the moving direction of the molded products and then in the same direction as the moving direction, whereby the water solvent can be brought into uniform contact with the molded products. In this system, desired molded products on the rotating disk can be selected according to their type and extraction time to sequentially take out of the water solvent vessel after an elapse of the processing time for each molded product, and new molded products can be loaded for immersion.

(C) A method for heat-degreasing and sintering molded products after water solvent extraction.

Figure 12:
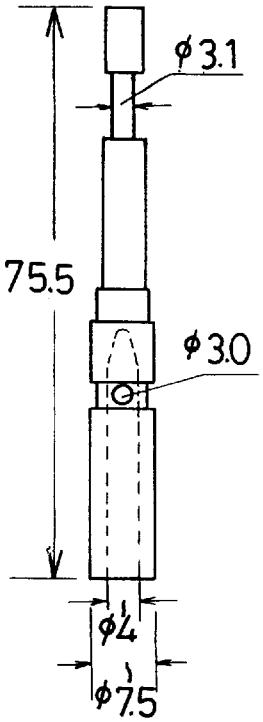
FIG. 12 is a view of a molded product c.

Binder C and a carbonyl iron powder material (CS iron powder produced by BASF, average particle diameter=5 microns) were mixed and heated at 140° C., cooled and then pulverized. The pulverized mixture was then injection-molded at an injection pressure of 660 kg/cm$^2$ to form molded products c as shown in FIG. 12. For comparison, a similar molded product was prepared using Binder K but this sample was not an acceptable product, because it was broken at the part marked by a circle in FIG. 12. After water solvent extraction at 100° C. for one hour, the molded products c prepared by use of Binder C underwent the following heat degreasing process.

The heat degreasing conditions are as follows:

(1) Degreasing level 1: the molded products were placed in a heat circulating furnace filled with a mixture of 10N1/min of $N_2$ gas and 0 to 0.05% by volume of $CO_2$ and degreased for 4 hours with a wind speed of 1.0 m/sec until a final temperature of 350° C. was reached.

(2) Degreasing level 2: Degreasing was carried out under the same conditions as the degreasing level 1 except that air was used in place of $N_2$ gas.

(3) Degreasing level 3: Degreasing was carried out under the same conditions as the degreasing level 1 except that $CO_2$ gas is used in place of $N_2$gas.

After degreasing, the products were vacuum-sintered at 1,200° C. for one hour. The sintered products were checked in terms of defects and residual carbon content. The result of the check is shown in Table 4.

TABLE 4

| | LEVEL 1 | | LEVEL 2 | | LEVEL 3 | |
|---|---|---|---|---|---|---|
| ATMOSPHERIC GAS | DEGREASING DEFECT RATIO | RESIDUAL CARBON CONTENT | DEGREASING DEFECT | RESIDUAL CARBON CONTENT | DEGREASING DEFECT | RESIDUAL CARBON CONTENT |
| $N_2$ + $OCO_2$ | 0/50 | 0.65$^{wt}$% | 4/50 | 0.003$^{wt}$% | 0/50 | 0.012$^{wt}$% |
| 0.12 $CO_2$ | 0/50 | 0.43 | | | | |
| 0.24 $CO_2$ | 0/50 | 0.32 | | | | |
| 0.36 $CO_2$ | 0/50 | 0.21 | | | | |
| 0.50 | 0/50 | 0.10 | | | | |

All the products degreased at the degreasing level 1 were acceptable. A few degreased products of the degreasing level 2 were slightly cracked. This was due to the oxide film which was created on the surface of powder material exposed to high temperature during degreasing in the atmosphere and due to the residual stress generated by the carbonization of the binder in the course of heat decomposition. In the degreased products of the level 1, this problem is solved by adjusting the gas atmosphere. It is evident that by virtue of mixing $CO_2$ with $N_2$, the residual carbon content of the sintered products can be accurately controlled. Further, the carbon content of the degreased products can be easily controlled during the heat degreasing step after water solvent extraction, which eliminates the need for adjusting the carbon content during the subsequent sintering step, and as a result, vacuum sintering which can be carried out in an economically desirable system becomes possible. In addition, this technique can effectively cope with variations in residual carbon content caused by use of different types of binders.

It was found that the degreased products of the level 3 in which $CO_2$ gas was used alone were free from cracks and were controlled so as to have residual carbon contents of 1 wt % or less.

The effect achieved by the addition of $CO_2$gas is as follows. The oxidation reaction of $CO_2$ gas at atmospheric pressure is described by $$C(S)+CO_2(G)=2CO(G);\ \Delta G1=40800-41.7T$$

so that $CO_2$ gas serves as a protective gas against oxidation which is an endothermic reaction until about 700° C. and the partial pressure of $CO_2$ gas drops when it is mixed with cracked gas generated by thermal decomposition or with $N_2$ gas, so that the process can be proceeded while the oxidation property of the product being easily controlled according to Le Chatelier's Law. In addition, in the presence of $CO_2$ gas, the binder remaining in a molded product can be easily decomposed into a low molecular gas such as CO gas, resulting in drastic reduction of heat degreasing time, so that heat degreasing can be carried out in a sintering furnace while sintering temperature being increased. This means that it is practically feasible to carry out "water solvent extraction and sintering process" from which a heat degreasing step is omitted.

We claim:

1. A water solvent extraction degreasing method for degreasing an organic binder contained in a molded product formed by injection molding of a powder material mixed with the organic binder, wherein said organic binder is composed of a water-fix soluble organic binder component having no thermal plasticity and a substantially negligible degree of polymerization and a water-soluble thermoplastic resin and wherein a degreasing step includes a water solvent extraction step for extracting said water-soluble organic binder component from the organic binder contained in the molded product with a solvent that contains water as its main component.

2. A water solvent extraction degreasing method according to claim 1, wherein said water-soluble organic binder component is composed of one or more substances selected from water-soluble amide compounds and water-soluble amine compounds, said water-soluble amide compounds and amine compounds having a molecular weight of about 1,000 or less.

3. A water solvent extraction degreasing method according to claim 2, wherein the water-insoluble thermoplastic resin is a polyamide resin.

4. A water solvent extraction degreasing method according to claim 1, 2 or 3, wherein, in said water solvent extraction step, the temperature of the water solvent is adjusted so as to increase from room temperature to a temperature that falls in the melting point or glass temperature of the water-insoluble thermoplastic resin and the boiling and/or convection effect of the water solvent is utilized.

5. A water solvent extraction degreasing method according to claim 4, wherein the temperature adjustment of the water solvent is carried out under pressure or reduced pressure.

6. A water solvent extraction degreasing method according to claim 4, wherein agitation utilizing said boiling effect or convection effect is achieved by changing from a depressurized condition to a pressurized condition.

7. A water solvent extraction degreasing method according to any one of claims 1, 2 or 3, wherein, in said water solvent extraction step, the molded product is moved in the water solvent thereby bringing the molded product into uniform contact with the water solvent.

8. A water solvent extraction degreasing method according to claim 7, wherein the movement of the molded product within the water solvent is a linear or circular movement in one or reciprocative direction.

9. A water solvent extraction degreasing method according to claim 4, wherein gas bubble is introduced into the water solvent to achieve uniform temperature and quick cooling or quick heating and to achieve agitation and convection effects.

10. A water solvent extraction degreasing method according to claim 2, wherein the water-soluble amide compounds are substances having amide groups while the water-soluble amine compounds are substances having amine groups and wherein these water-soluble amide compounds and water-soluble amine compounds pounds have melting points ranging from 50° C. to 190° C. and boiling points of 175° C. or more.

11. A water solvent extraction degreasing method according to claim 3, wherein said polyamide resin is composed of a polyamide resin material having 8 or more carbon atoms between amide groups on average and an aromatic bisamide having 8 or more carbon atoms between amide groups on average and serving as a compatibilizer, the polyamide resin material and the aromatic bisamide being mixed substantially at an equal weight ratio.

12. A water solvent extraction degreasing method according to claim 11, wherein said aromatic bisamide is composed of one ore more substances selected from the group consisting of (i) xylylene bis stearic acid amide, (ii) N,N'-distearyl isophthalic acid amide, and (iii) N,N'-distearyl terephthalic acid amide.

13. A water solvent extraction degreasing method according to claim 3, wherein said polyamide resin is composed of one or more polyamide resin materials having 10 or more carbon atoms between amide groups on average.

14. A water solvent extraction degreasing method according to claim 3, wherein said polyamide resin is composed of (i) a polyamide resin material having 8 or more carbon atoms between amide groups on average, (ii) an aromatic bisamide having 8 or more carbon atoms between amide groups on average and serving as a compatibilizer, the polyamide resin material and the aromatic bisamide being mixed substantially at an equal weight ratio, and (iii) two or more polyamide resin materials having 10 or more carbon atoms between amide groups on average.

15. A water solvent extraction degreasing method according to any one of claims 11 to 14, wherein the polyamide resin materials are respectively prepared from copolycondensation of (i) $C_{36}$-dimeric acid, $C_{44}$-dimeric acid, or a mixture of $C_{36}$-dimeric acid and $C_{44}$-dimeric acid, (ii) aliphatic dicarboxylic acid having 6 to 10 carbon atoms, (iii) xylylenediamine, and (iv) ethylenediamine and/or hexamethylenediamine.

16. A water solvent extraction degreasing method according to claim 15, wherein the average molecular weight of each of the polyamide resin materials is 20,000 or more.

17. A water solvent extraction degreasing method according to any one of claims 11 to 14, wherein said polyamide resin materials contain nylon 11 and nylon 12 as major components.

18. A water solvent extraction degreasing method according to claim 17, wherein the average molecular weight of each of the polyamide resin materials is 13,000 or more.

19. A water solvent extraction degreasing method according to claim 2 or 3, wherein the water used in said water solvent extraction step is in the state of shower or heated steam.

20. A water solvent extraction degreasing method according to any one of claim 1, 2, 3 10, 11, 12, 13 and 14, which further comprises a heat decomposition removing step for heat-decomposing and removing the binder that remains after extraction of the water-soluble organic binder component in said water solvent extraction step.

21. A water solvent extraction degreasing method according to claim 20, wherein in said heat decomposition removing step, a heating furnace is so adjusted as to have an atmosphere of one or more gases selected from the group consisting of inert gases and $CO_2$ gases so that the residual carbon content of a resultant degreased product and the residual carbon content of a sintered product obtained from sintering after degreasing can be adjusted.

22. A water solvent extraction degreasing method according to any one of claims 11 to 14, wherein the organic binder used for producing the molded product has a composition of 20 to 80 wt % the water-soluble amide compound(s) and/or water-soluble amine compound(s) and 20 to 65 wt % the polyamide resin.

23. A water solvent extraction degreasing method according to claim 22, wherein 15 wt % or less of a lubricant is used.

24. A molded product obtained from degreasing with the water solvent degreasing method as set forth claim 1.

25. A degreased product obtained after the residual binder has been removed in the heat decomposition removing step in the method of claim 20.

26. A water solvent extraction degreasing method according to claim 4, wherein, in said water solvent extraction step, the molded product is moved in the water solvent thereby bringing the molded product into uniform contact with the water solvent.

27. A water solvent extraction degreasing method according to claim 4, which further comprises a heat decomposition removing step for heat-decomposing and removing the binder that remains after extraction of the water-soluble organic binder component in said water solvent extraction step.

28. A water solvent extraction degreasing method according to claim 5, which further comprises a heat decomposition removing step for heat-decomposing and removing the binder that remains after extraction of the water-soluble organic binder component in said water solvent extraction step.

29. A water solvent extraction degreasing method according to claim 7, which further comprises a heat decomposition removing step for heat-decomposing and removing the binder that remains after extraction of the water-soluble organic binder component in said water solvent extraction step.

30. A water solvent extraction degreasing method according to claim 8, which further comprises a heat decomposition removing step for heat-decomposing and removing the binder that remains after extraction of the water-soluble organic binder component in said water solvent extraction step.

31. A water solvent extraction degreasing method according to claim 9, which further comprises a heat decomposition removing step for heat-decomposing and removing the binder that remains after extraction of the water-soluble organic binder component in said water solvent extraction step.

* * * * *